US007779602B2

(12) United States Patent
Collison

(10) Patent No.: US 7,779,602 B2
(45) Date of Patent: Aug. 24, 2010

(54) SNAP TOGETHER FLOOR STRUCTURE

(75) Inventor: Alan B. Collison, Pierce, NE (US)

(73) Assignee: CoMc, LLC, Omaha, NE (US)

( * ) Notice: Subject to any disclaimer, the term of this patent is extended or adjusted under 35 U.S.C. 154(b) by 0 days.

(21) Appl. No.: 12/563,156

(22) Filed: Sep. 20, 2009

(65) Prior Publication Data

US 2010/0005757 A1 Jan. 14, 2010

Related U.S. Application Data

(62) Division of application No. 11/137,705, filed on May 25, 2005, now Pat. No. 7,610,731.

(60) Provisional application No. 60/651,490, filed on Jan. 10, 2005.

(51) Int. Cl.
*E04B 1/00* (2006.01)

(52) U.S. Cl. ..... 52/747.1; 52/177; 52/591.3; 52/797.1; 52/747.11

(58) Field of Classification Search ..... 52/386, 52/590.2, 591.4, 591.3, 403.1, 384, 390, 52/460, 177, 747.11, 747.1
See application file for complete search history.

(56) References Cited

U.S. PATENT DOCUMENTS

| | | | | | |
|---|---|---|---|---|---|
| 2,303,745 | A | | 12/1942 | Karreman | |
| 3,016,316 | A | | 1/1962 | Olson | |
| 3,535,844 | A | | 10/1970 | Glaros | |
| 3,553,921 | A | | 1/1971 | Breistein | |
| 3,676,970 | A | * | 7/1972 | Edwards | 52/385 |
| 3,723,233 | A | | 3/1973 | Bourke | |
| 3,828,503 | A | * | 8/1974 | Hofmann | 52/393 |
| 4,095,388 | A | * | 6/1978 | Breault | 52/747.11 |
| 4,226,064 | A | * | 10/1980 | Kraayenhof | 52/180 |
| 4,453,365 | A | | 6/1984 | Gladden | |
| 4,550,543 | A | | 11/1985 | Valenzano | |
| 4,590,731 | A | | 5/1986 | DeGooyer | |
| 4,640,850 | A | | 2/1987 | Marocco | |
| 4,664,955 | A | | 5/1987 | Clem | |
| 4,807,412 | A | * | 2/1989 | Frederiksen | 52/177 |
| 4,840,825 | A | | 6/1989 | Aristodimou | |
| 4,901,490 | A | * | 2/1990 | Zinniel et al. | 52/263 |

(Continued)

FOREIGN PATENT DOCUMENTS

DE 2246778 B1 3/1974

(Continued)

*Primary Examiner*—Brian E Glessner
*Assistant Examiner*—Joshua Ihezie
(74) *Attorney, Agent, or Firm*—Edwin A. Sisson, Attorney at Law, LLC

(57) ABSTRACT

A floor structure unit, comprising: a tray, a flooring material, a rubber grommet, and a rubber matrix is provided. The tray includes an upper and lower horizontal surface, at least one retaining wall, a first and a second set of contrapositive interlocking members. The flooring material is disposed on the tray upper horizontal surface such that the first set of interlocking members is substantially flush with the flooring material and the second set of interlocking members extends beyond the flooring material. The rubber matrix is disposed in the tray lower horizontal surface, and the rubber grommet is disposed about the perimeter of the at least one retaining wall. The rubber grommet and the rubber matrix are a unitary piece. Methods of manufacture and use thereof are also provided.

2 Claims, 6 Drawing Sheets

U.S. PATENT DOCUMENTS

| | | | | | |
|---|---|---|---|---|---|
| 4,917,532 | A | | 4/1990 | Haberhauer et al. | |
| 4,931,331 | A | | 6/1990 | Owens | |
| 5,052,158 | A | | 10/1991 | D'Luzansky | |
| 5,103,614 | A | | 4/1992 | Kawaguchi et al. | |
| 5,111,627 | A | * | 5/1992 | Brown | 52/126.5 |
| D347,722 | S | * | 6/1994 | Apps | D3/314 |
| 5,386,670 | A | * | 2/1995 | Takeda et al. | 52/126.6 |
| 5,418,036 | A | | 5/1995 | Tokikawa et al. | |
| 5,616,389 | A | | 4/1997 | Blatz | |
| 5,618,602 | A | * | 4/1997 | Nelson | 428/60 |
| 5,678,369 | A | * | 10/1997 | Ishikawa et al. | 52/309.9 |
| 5,806,270 | A | | 9/1998 | Solano | |
| 5,899,040 | A | | 5/1999 | Cerrato | |
| 5,950,378 | A | * | 9/1999 | Council et al. | 52/177 |
| 6,004,652 | A | * | 12/1999 | Clark | 428/133 |
| 6,021,615 | A | | 2/2000 | Brown | |
| 6,032,428 | A | * | 3/2000 | Rosan et al. | 52/592.1 |
| 6,098,354 | A | * | 8/2000 | Skandis | 52/177 |
| 6,247,286 | B1 | | 6/2001 | Heyns | |
| 6,684,592 | B2 | * | 2/2004 | Martin | 52/591.5 |
| 6,694,689 | B1 | * | 2/2004 | Scott et al. | 52/392 |
| 6,769,217 | B2 | * | 8/2004 | Nelson | 52/582.1 |
| 6,802,159 | B1 | * | 10/2004 | Kotler | 52/177 |
| 7,114,298 | B2 | * | 10/2006 | Kotler | 52/177 |
| 7,197,855 | B2 | * | 4/2007 | Della Pepa | 52/460 |
| 7,543,417 | B2 | * | 6/2009 | McIntosh et al. | 52/589.1 |
| 2002/0189176 | A1 | * | 12/2002 | Stegner et al. | 52/177 |
| 2002/0189182 | A1 | * | 12/2002 | Record | 52/309.9 |
| 2003/0074855 | A1 | * | 4/2003 | Nelson | 52/586.2 |
| 2003/0097808 | A1 | * | 5/2003 | Sabatini | 52/384 |
| 2003/0154676 | A1 | * | 8/2003 | Schwartz | 52/391 |
| 2003/0233809 | A1 | * | 12/2003 | Pervan | 52/783.1 |
| 2004/0074190 | A1 | * | 4/2004 | Lin et al. | 52/592.1 |
| 2004/0187423 | A1 | | 9/2004 | Weber | |
| 2004/0226242 | A1 | * | 11/2004 | Moller, Jr. | 52/384 |
| 2005/0034395 | A1 | * | 2/2005 | Kotler | 52/384 |
| 2005/0039413 | A1 | * | 2/2005 | Schrotenboer | 52/582.1 |
| 2005/0144867 | A1 | * | 7/2005 | Clarke | 52/389 |
| 2005/0144879 | A1 | | 7/2005 | Fiorino | |
| 2005/0200062 | A1 | * | 9/2005 | Maurer et al. | 267/144 |
| 2005/0208255 | A1 | * | 9/2005 | Pervan | 428/60 |
| 2007/0094969 | A1 | * | 5/2007 | McIntosh et al. | 52/386 |
| 2007/0094979 | A1 | * | 5/2007 | Richardson et al. | 52/578 |
| 2007/0227090 | A1 | * | 10/2007 | Plante | 52/506.01 |
| 2008/0173569 | A1 | * | 7/2008 | Forsyth | 206/725 |

FOREIGN PATENT DOCUMENTS

| | | | |
|---|---|---|---|
| DE | 20009717 | A1 | 12/2000 |
| DE | 19962812 | A1 | 6/2001 |
| DE | 20205774 | U1 | 4/2002 |
| DE | 202004017921 | U1 | 1/2005 |
| DE | 102006021426 | A1 | 11/2007 |
| EP | 0256189 | B1 | 2/1988 |
| EP | 0544604 | B1 | 2/1993 |
| EP | 1039057 | A1 | 9/2000 |
| EP | 1146182 | A1 | 10/2009 |
| GB | 1350754 | A1 | 4/1970 |
| GB | 2216976 | A | 10/1989 |
| GB | 2284846 | A | 6/1995 |
| GB | 2307489 | A | 5/1997 |
| WO | 0008274 | A1 | 2/2000 |
| WO | 02101175 | A1 | 12/2002 |
| WO | 03040491 | A1 | 5/2003 |
| WO | 2004070134 | A1 | 8/2004 |
| WO | 2004081316 | A1 | 9/2004 |
| WO | 2005098164 | A1 | 10/2005 |

* cited by examiner

SNAP TOGETHER FLOOR STRUCTURE

CROSS-REFERENCE TO RELATED APPLICATIONS

This application is a divisional of U.S. patent application Ser. No. 11/137,705 now U.S. Pat. No. 7,610,731, file May 25, 2005 which is a continuation-in-part of U.S. patent application Ser. No. 11/032,196 filed on Jan. 10, 2005 and converted to a U.S. Provisional Application Ser. No. 60/651,490 on May 20, 2005 and having a filing date of Jan. 10, 2005. Priority is claimed from all the above applications.

FIELD OF THE INVENTION

The present invention relates to floor coverings and methods of use thereof.

BACKGROUND OF THE INVENTION

Applying new flooring may provide enhanced aesthetic appeal or fulfill a functional purpose. Generally, applying flooring requires the use of staples, nails or an adhesive to adhere the flooring material to the sub-floor. Depending on the combination of sub-floor type, new flooring installed and the particular adhesive used, applying new flooring may damage the sub-floor through scuffing, gauging, nail holes or chemical damage. For example, with marble floors, a conventional installation damages the sub-floor from the tar paper, wire mesh, mortar bed, adhesive and grout used to lay the marble, and the damage is compounded by the weight of the marble and use of the floor. This may be undesirable and require extensive restoration efforts if the sub-floor is hardwood.

Furthermore, certain flooring materials may be expensive and the addition of labor expenses may make a new floor unattainable for price-conscious consumers. While a do-it-yourself application may reduce the costs, some consumers may be apprehensive to use particular adhesives or grout which may require planning for timing, ventilation and settling. For example, using a cement backer board, which is designed to be easier than the conventional installation described above, requires that a cement board be attached to a plywood sub-floor using adhesives and screws, then bonding the tile to the backer board using a thin set adhesive placed over a fiberglass reinforcing mesh.

It may be desirable to provide a "floating" floor structure which provides the appearance of a permanent flooring structure at a reduced cost but without the use of damaging permanent attachment means to secure the structure to the floor. It may be desirable that the installation is primarily mechanical, not requiring the use of chemical adhesives. It may also be desirable to provide a floor structure that is stable and does not substantially shift upon using the floor.

SUMMARY OF THE INVENTION

The present invention provides a floor structure unit, comprising: a tray, a flooring material, a rubber grommet, and a rubber matrix. The tray includes an upper horizontal surface, a lower horizontal surface, at least one retaining wall extending vertically from either of the horizontal surfaces, a first set of interlocking members, and a second set of interlocking members, where the first set of interlocking members and the second set of interlocking members are contrapositive. The flooring material is disposed on the tray upper horizontal surface such that the first set of interlocking members is substantially flush with the flooring material and the second set of interlocking members extends beyond the flooring material. The rubber matrix is disposed in the tray lower horizontal surface, and the rubber grommet is disposed about the perimeter of the at least one retaining wall. The rubber grommet and the rubber matrix are a unitary piece.

The present invention also provides a method of making a floor structure unit, comprising providing tray having interlocking members disposed thereon; placing a rubber grommet around the perimeter of the tray; attaching a rubber matrix onto a lower horizontal surface of the tray; and securing a flooring material to an upper horizontal surface of the tray.

The present invention also provides a method of placing a floor structure, comprising: interlocking contrapositive members of at least two floor structure units. The floor structure units comprise: a tray, a flooring material, a rubber grommet, and a rubber matrix. The tray includes an upper horizontal surface, a lower horizontal surface, at least one retaining wall extending vertically from either of the horizontal surfaces, a first set of interlocking members, and a second set of interlocking members, where the first set of interlocking members and the second set of interlocking members are contrapositive. The flooring material is disposed on the tray upper horizontal surface such that the first set of interlocking members is substantially flush with the flooring material and the second set of interlocking members extends beyond the flooring material. The rubber matrix is disposed in the tray lower horizontal surface, and the rubber grommet is disposed about the perimeter of the at least one retaining wall. The rubber grommet and the rubber matrix are a unitary piece.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
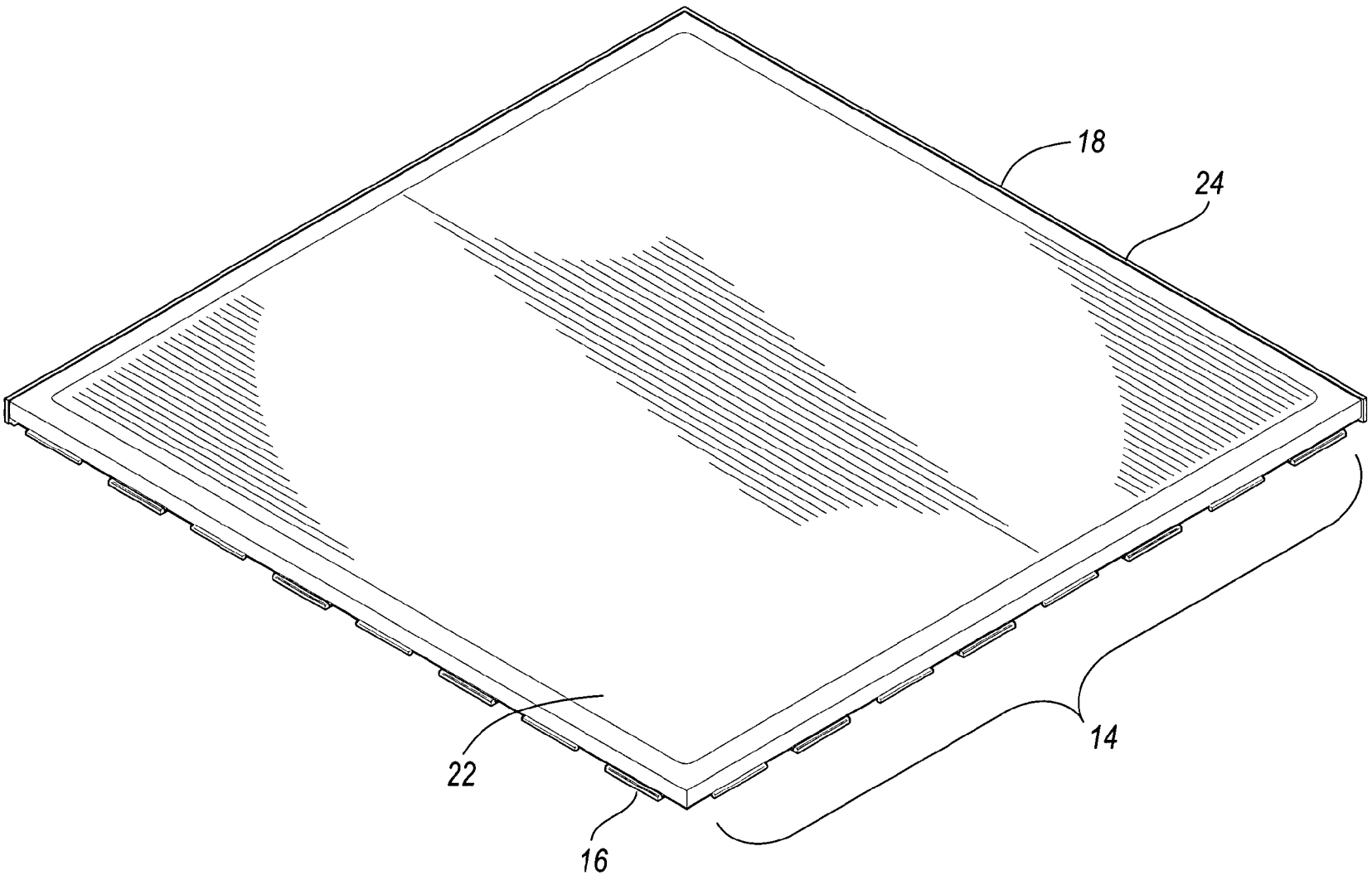
FIG. 1 depicts a perspective view of a floor structure unit according to embodiments of the present invention.

The following description of the preferred embodiment(s) is merely exemplary in nature and is in no way intended to limit the invention, its application, or uses.

FIGS. 1-4 depict a floor structure unit 10 comprising a tray 12, having a first set 14 of interlocking members 16, a second set 18 of interlocking members 16, a rubber matrix 20, a flooring material 22, and a rubber grommet 24. The tray 12, the rubber matrix 20, the flooring material 22 and the rubber grommet 24 of the floor structure unit 10 are attached using an adhesive or glue.

Figure 3:
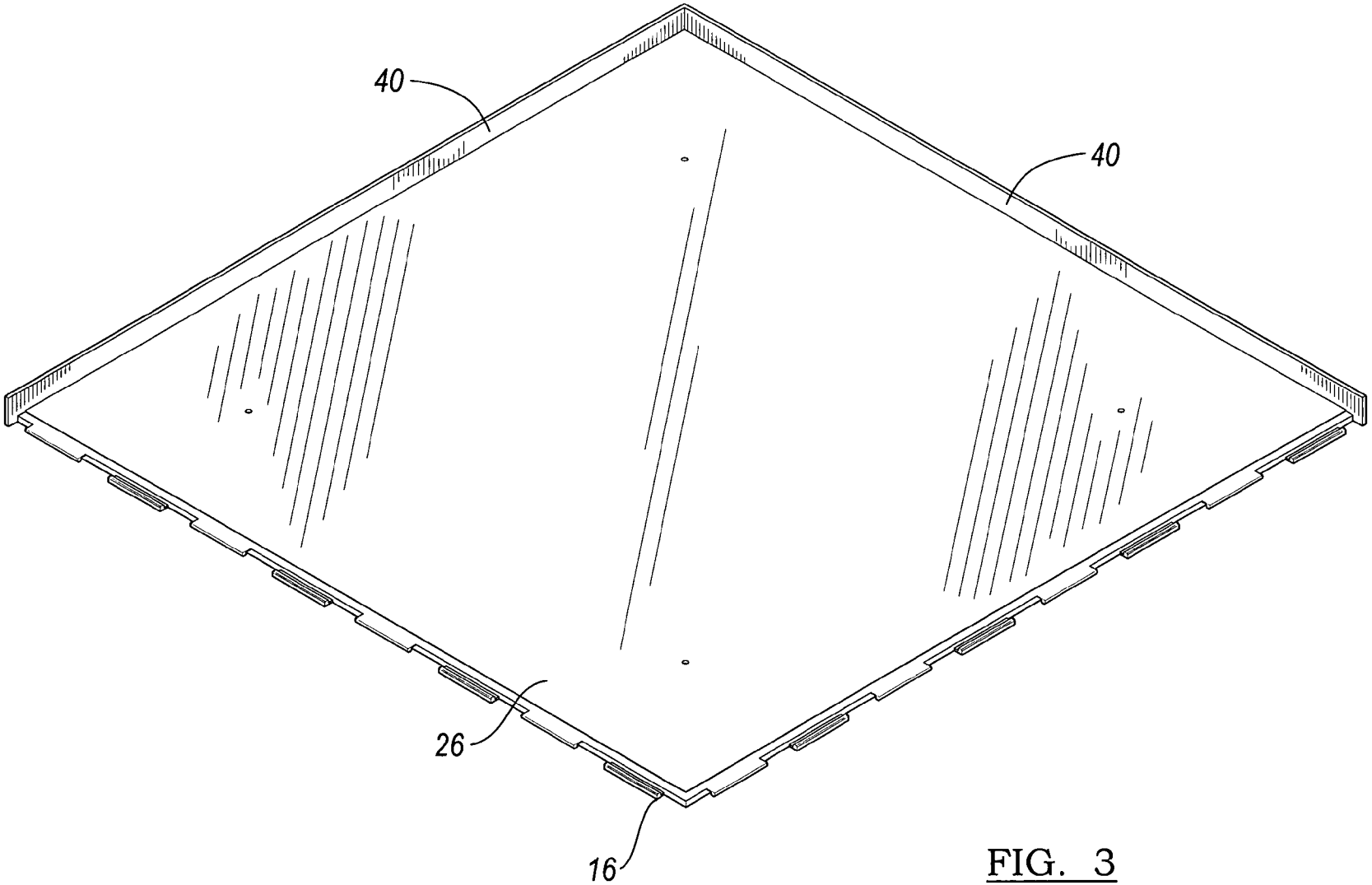
FIG. 3 depicts a perspective view of a tray and retaining walls according to embodiments of the present invention.

As depicted in FIG. 3, the tray 12 is a square and comprises an upper horizontal surface 26 and a lower horizontal surface 28. It is understood that the tray 12 may be of any appropriate shape (polygon, circular, freeform, etc.) and a square is depicted and discussed herein for illustrative purposes only and that one skilled in the art appreciates and understands slight modifications to accommodate various shapes. The upper horizontal surface 26 is the substrate for the flooring material 22 as discussed later herein.

The lower horizontal surface 28 includes the substrate for the sets of interlocking members 14 and 18 and serves as the substrate for attachment of the rubber matrix 20 and interconnected rubber grommet 24. Each tray 12 interlocking member 16 comprises a notch 30 and a recessed segment 32. The notch 30 is generally a protrusion of a greater thickness than the recessed segment 32. The protrusion may be rounded, squared or an irregular shape. The notch 30 connects with the recessed segment 32 of an adjacent floor structure unit 10 for a secure fit. Generally, the notch 30 of a first interlocking member 16 connects with the recessed portion 32 of a second interlocking member 16. In various embodiments, it may be desirable to have complimentary shaped notches 30 and recessed segments 32. For example, a rounded notch 30 mating with a rounded hollowed recessed segment 32 may provide a secure fit thereby preventing slippage of the floor structure.

Figure 2:
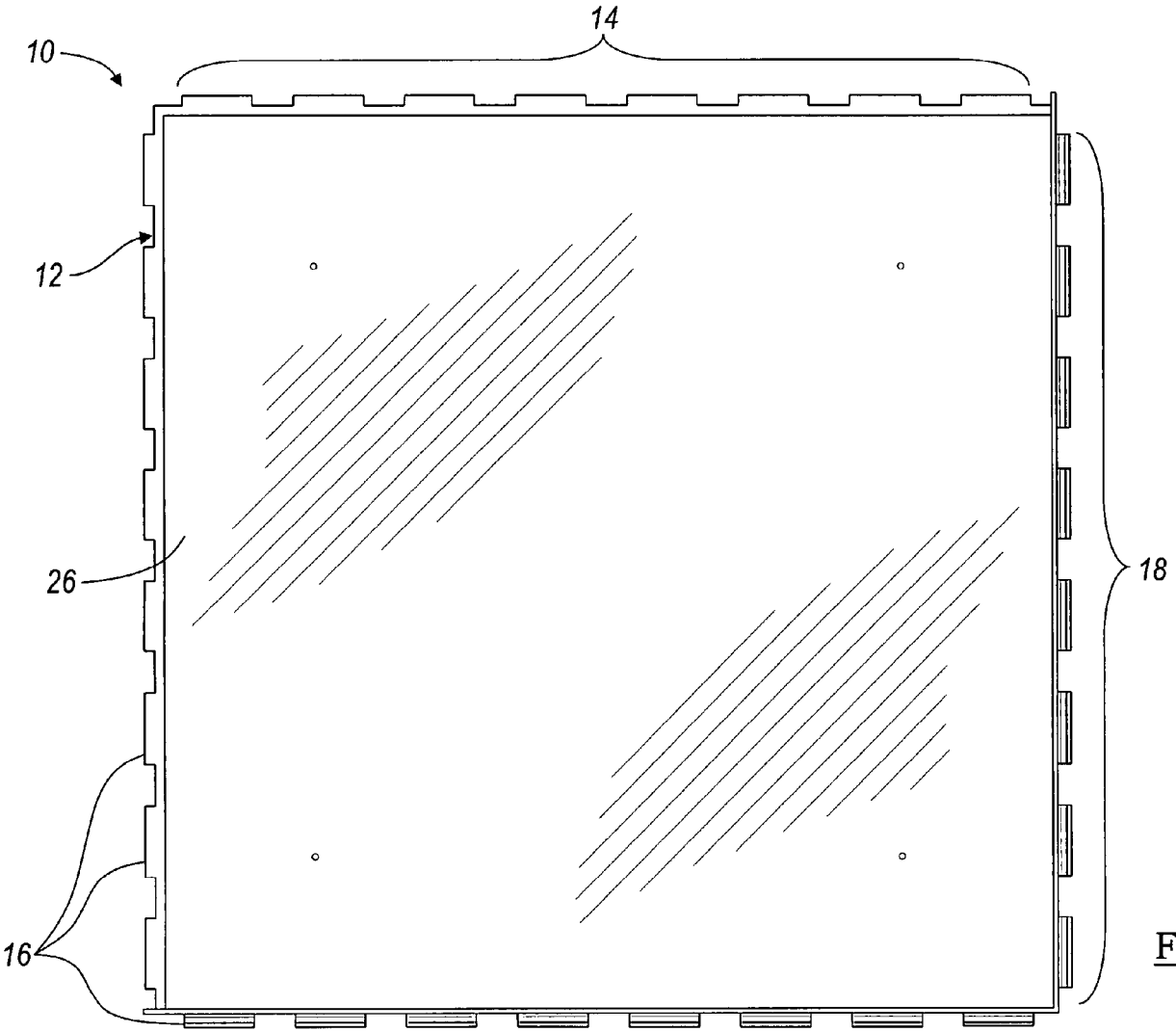
FIG. 2 depicts a top view of a tray according to embodiments of the present invention.
Figure 4:
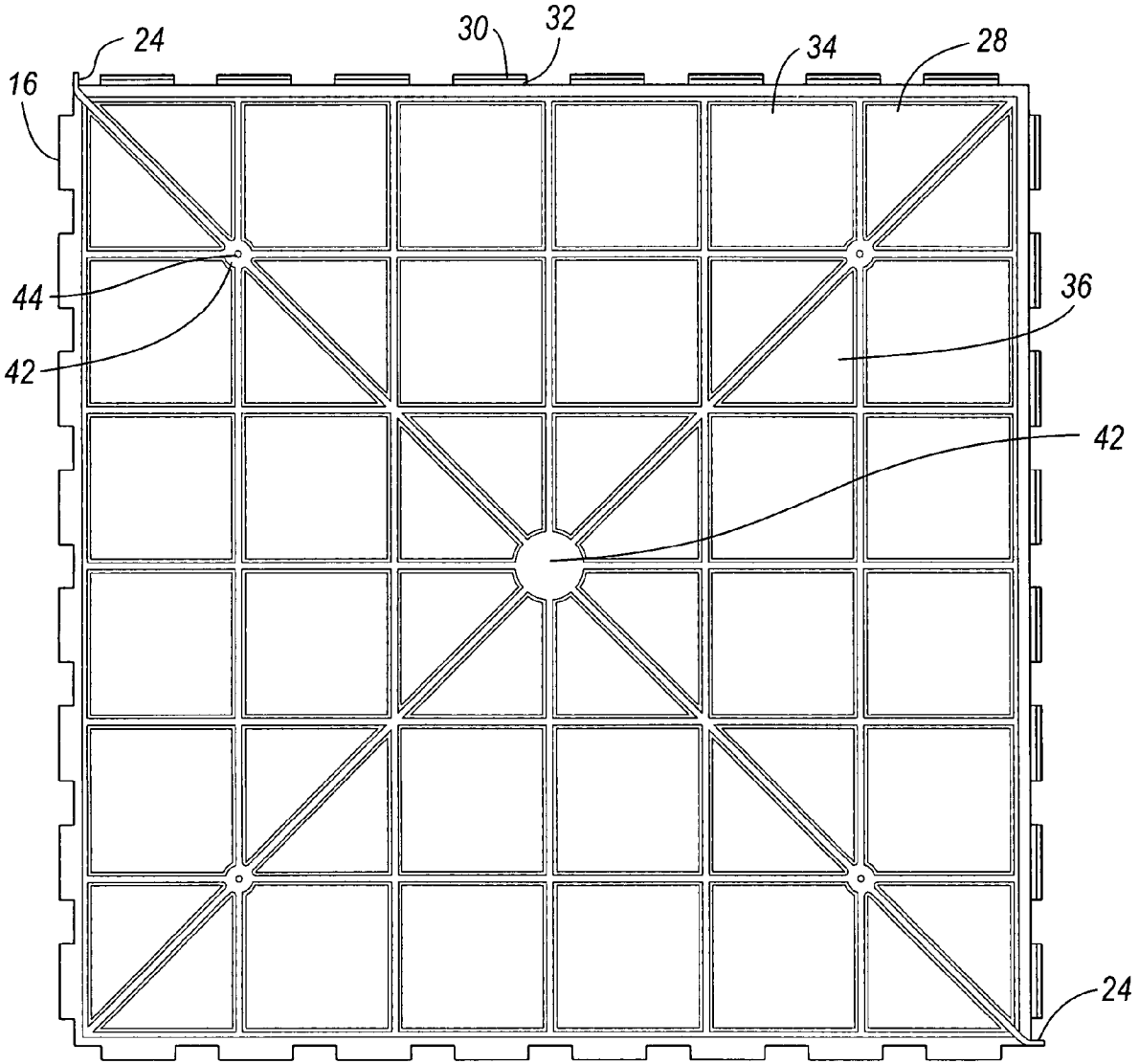
FIG. 4 depicts a bottom view of a tray, rubber grommet, and rubber matrix according to embodiments of the present invention.
Figure 5:
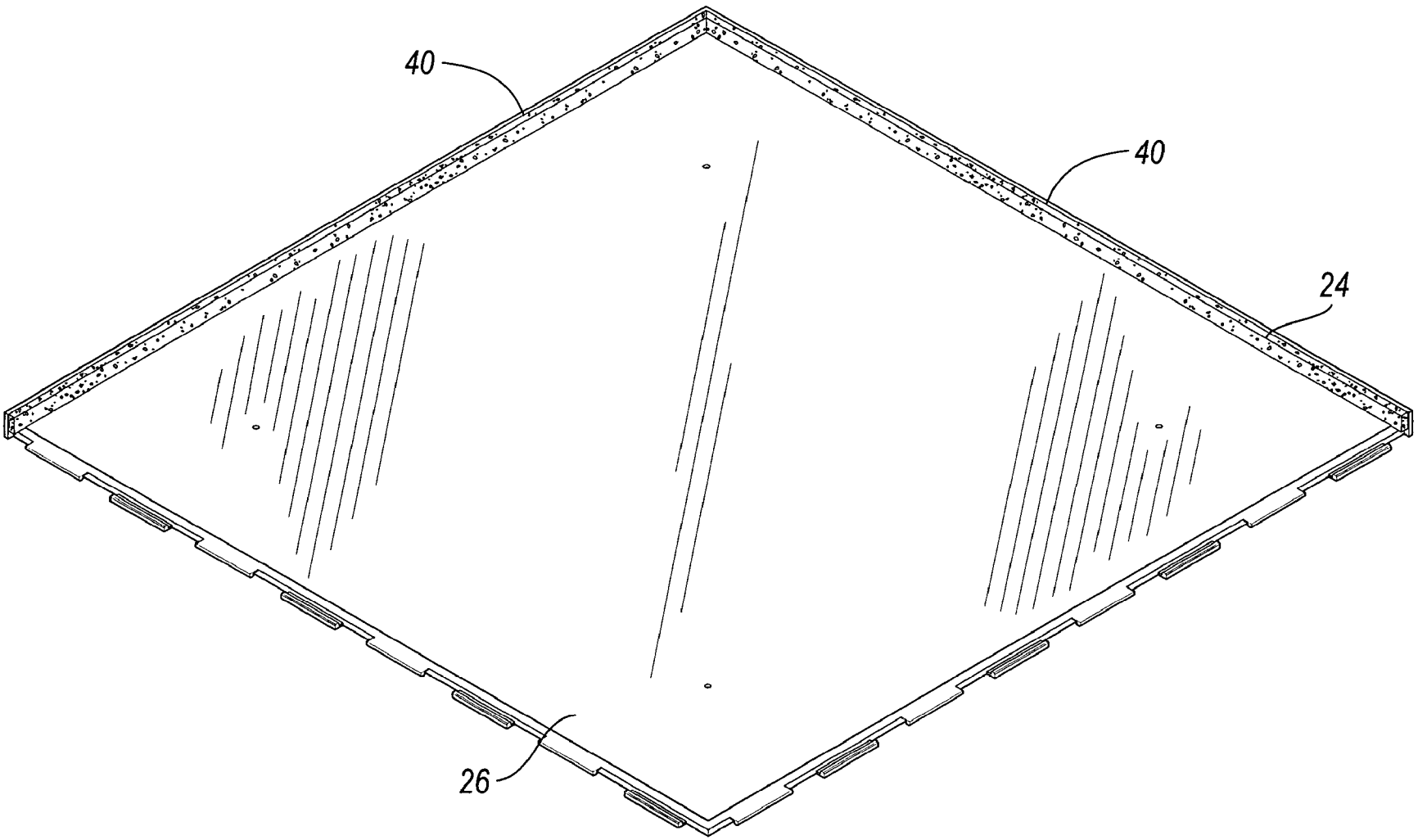
FIG. 5 depicts a perspective view of a tray and rubber grommet according to embodiments of the present invention.

The sets 14 and 18 of interlocking members 16 may be arranged such that all of the notches 30 face towards either the upper horizontal surface 26 or lower horizontal surface 28 of the tray 12, as depicted in FIGS. 2 and 4. Preferably, each interlocking member 16 of the sets 14 and 18 alternate where one notch 30 faces towards the upper horizontal surface 26 and then the adjacent notch 30 faces towards the lower horizontal surface 28, as depicted in FIGS. 1, 3, and 5. In a preferred embodiment, the notches 30 and recessed segments 32 are arranged such that the first set 14 and the second set 18 of interlocking members 16 are contrapositive. This contrapositive arrangement provides the lock fit and structural integrity of the flooring system.

The lower horizontal surface 26 may also comprise a grid 34. The grid 34 may be produced when the tray 12 is injection molded. The grid 34 may include any geometric or curved pattern or a random pattern to provide greater surface area for the rubber matrix 20 and in various embodiments, an optional adhesive 36.

Referring to FIG. 5, the tray 12 may also include retaining or side walls 40. These walls 40 may be used to hold the flooring material 22 in a fixed position, provide strength, and prevent debris from reaching the sub-floor. Preferably, the retaining walls 40 upwardly extend from two adjacent sides of the tray 12. The retaining walls 40 provide enhanced support to components of the flooring unit 10. The walls 40 support the rubber grommet 24 on the tray 12, as further detailed later herein, and are used as a projection point for interlocking members 16, as depicted in FIGS. 7*a-c* and FIG. 8.

Figure 6:
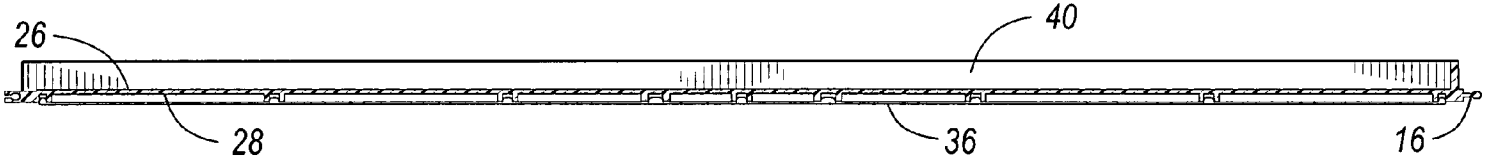
FIG. 6 depicts a side view of a floor structure unit according to embodiments of the present invention.

Referring to FIG. 6, the flooring material 22 is disposed on the upper horizontal surface 26 of the tray 12. Flooring materials 22 may include traditional materials 22 such as stone, wood, ceramic, textile, paper, plastic materials 22, and mixtures thereof. Stone materials preferably include slate, limestone, flagstone, granite, marble, or aggregates thereof. Depending on the flooring material 22 selected, the tray 12 shape and dimensions may be adapted for proper structural integrity and aesthetic appeal. The flooring material 22 may be a solid color, pattern, or contain a grain or texture. The flooring material 22 may be a solid or contain a decoration, for example, a marble unit having glass covered cut away which houses a contrasting color wood. Various combinations of flooring materials 22 provide endless options for function and decoration.

Returning to FIG. 4, the rubber matrix 20 provides a contact surface for the sub-floor 38. The term "matrix" is used to represent a series of interconnected points and does not imply any particular geometry. As depicted, the rubber matrix 20 is a collection of intersecting lines forming a plurality of right angled structures. It is understood that the rubber matrix 20 may include any geometric or curved pattern or random pattern to provide a surface area for contact with the sub-floor 38. The rubber matrix 20 may be of consistent dimensions or it may include regions 42 having an increased thickness or width. As depicted, the rubber matrix 20 includes a plurality of circular regions 42 at select line intersections. These regions 42 may be of any appropriate diameter or cross section depending on the particular shape selected. The regions 42 may include polygonal, circular or freeform shapes. The regions 42 may match in shape or may be a plurality of shape combinations and sizes. Additionally, the regions 42 may include depressed or raised sub-regions 44. These sub-regions 44 may provide supplemental protection for the sub-floor 38, allow for expansion or reduction of the selected materials 22 due to changes in temperature and provide structural support for the floor structure unit 10. In various embodiments, the sub-regions 44 may be used as an alignment guide for a user. For example, in an embodiment combining circular and hexagonal regions 42, the user may be instructed to align the components so that the hexagons are aligned with hexagons and the circles aligned with other circles. This may be particularly useful when applying a floor structure unit 10 of different colors or creating a pattern (such as a multi-level diamond, herringbone or zigzag) in the finished floor using a collection of floor structure units 10.

The rubber matrix 20 may be made of any suitable rubber, including but not limited to natural rubber, cis-polyisoprene, polybutadiene, poly(styrene-butadiene), styrene-isoprene copolymers, isoprene-butadiene copolymers, styrene-isoprene-butadiene tripolymers, polychloroprene, chloroisobutene-isoprene, nitrile-chloroprene, styrene-chloroprene, and poly (acrylonitrile-butadiene). Additives such as coloring agents, strength enhancing agents, or friction modifying agents may be added to the rubber.

Referring to FIGS. 7*a-c* and 8, the rubber grommet 24 is disposed about the perimeter of at least one retaining wall 40 of the tray 12. The rubber grommet 24 advantageously provides support and impact cushioning in the lateral and longitudinal directions with respect to the tray 12. This is particularly useful to prevent damaging of fragile flooring materials 22 when they are joined together. The grommet 24 resembles grout and grout joints because when the floor structure is assembled, the rubber grommet 24 engages a region of the flooring material 22 on an adjacent tile. Preferably, the rubber grommet 24 is sufficiently resilient to maintain its shape when a bare region of flooring material 22 is placed against the rubber grommet 24, as detailed later herein.

Figure 7A:
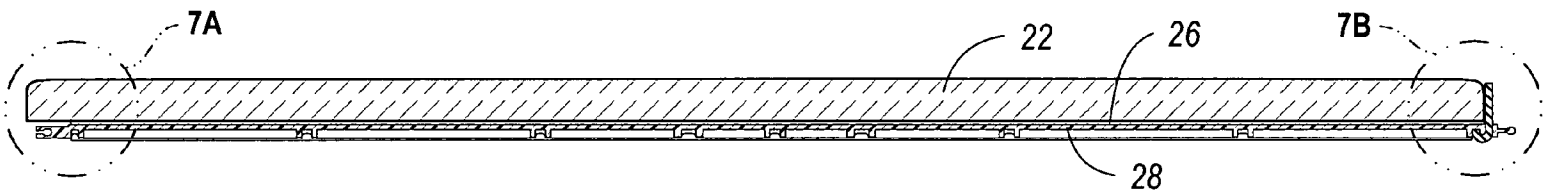
FIG. 7*a* depicts a side view of a floor structure unit according to embodiments of the present invention.
Figure 7C:
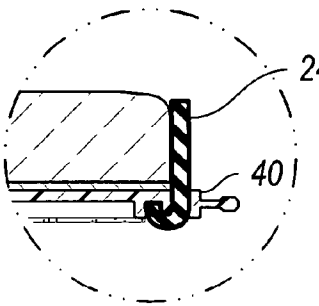
FIGS. 7*b-c* depict exploded corner views of the side view of FIG. 7*a*.
Figure 7B:
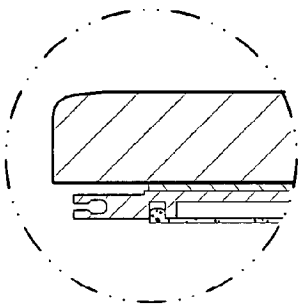
Figure 8:
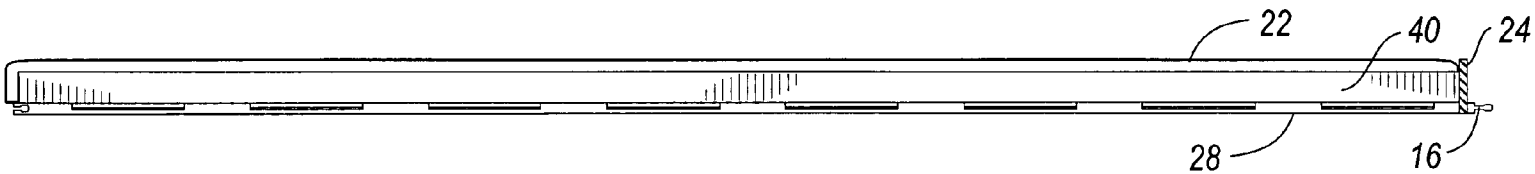
FIG. 8 depicts a side view of a tray, stone and rubber grommet according to embodiments of the present invention.

As best depicted in FIGS. 4 and 7*c*, the rubber grommet 24 and the rubber matrix 20 are a unitary piece. The region of the rubber grommet 24 surrounding the perimeter of the retaining walls 40 along the tray lower surface 28 forms an outer edge of the rubber matrix 20. The monolithic matrix 20 and grommet 24 unexpectedly provides enhanced cushioning, absorption of footfall impact and noise, and eliminates shifting of the new floor because energy transfer is limited to between the rubber matrix 20 and rubber grommet 24 instead of to the floor structure unit 10 and flooring material 22. Furthermore, the monolithic structure eliminates debris from reaching the sub-floor 28. If any debris invades the flooring unit 10, the debris is trapped between the region of the rubber grommet 24 surrounding the perimeter of the retaining walls 40 that forms the outer edge of the rubber matrix.

The rubber grommet 24 color may be of the same or different color(s) as the flooring material 22 or it may be an accent color entrained in a multi-colored flooring material 22 such as marble. The rubber grommet 24 may be made of the same rubber materials used for the rubber matrix 20.

Between the voids in the rubber matrix 20, an adhesive 36 may be applied. Suitable adhesives 36 include thermoplastic adhesives, thermosetting adhesives and rubber-resin blends. Specific examples of adhesives 36 include acrylic resin adhesive, cyanoacrylate adhesives, epoxy adhesives, phenolic adhesives, polyurethane adhesives, adhesives incorporating a dispersed, physically separated but chemically attached rubber phase, and mixtures thereof. Preferably, the adhesive 36 is a methacrylate-based adhesive. For example, a preferable adhesive 36 may comprise dodecyl methacrylate, hexadecyl methacrylate, poly(butadiene, methylmethacrylate and styrene), chlorosulfonated polyethylene, methacrylic acid and a methyl methacrylate monomer. Various factors including the particular flooring material 22 selected, the surface area covered by the rubber matrix 20 and the textured grid 34 of the tray 12 may be incorporated in the selection of the adhesive 36.

The floor structure unit 10 is made by first providing a tray 12 having interlocking members 16 disposed thereon. The tray 12 may be made using injection molding. The details of the tray 12 including the textured grid 34, interlocking members 16, notches 30 and recessed segments 32, may be constructed during a single injection molding step or a combination of steps such as an injection molding followed by pressing a form onto the tray 12.

Placing the rubber grommet 24 and placing the rubber matrix 20 may be performed as distinct steps or a single step. In a preferred embodiment, the rubber matrix 20 is applied using double injection molding techniques and where the tray 12 materials and the rubber materials are injected into the same mold to form a single part. Double injection molding is preferred because the process may be designed to reduce assembly labor and may prevent defects in the flooring unit from improper orientation that may affect individual parts.

To place the new floor structure, the notches 30 on a first floor structure unit 10 are aligned with the contrapositive notches 30 or a second floor structure unit 10. The notches 30 and recessed segments 32 may be engaged by pushing or snapping the units together. Manual pressure or a tool such as a hammer or mallet may be used to engage the interlocking members 16. Preferably, the flooring units 10 are aligned such that the retaining walls 40 of one flooring unit 10, engage bare flooring materials 22 of adjacent flooring units 10. The process is repeated until the desired pattern or "floating" floor size is achieved. As stated above, the rubber grommet 24 is sufficiently resilient such that when the floor units 10 are engaged, the rubber grommet 24 serves as a cushion between edges of bare flooring material 22. Preferably, the rubber grommet 24 is able to withstand the accumulation of pressure resultant from laying a plurality of flooring units 10 in various directions and combinations.

The description of the invention is merely exemplary in nature and, thus, variations that do not depart from the gist of the invention are intended to be within the scope of the invention. Such variations are not to be regarded as a departure from the spirit and scope of the invention.

I claim:

1. A method of placing a floor structure, comprising:

a. interlocking contrapositive members of at least two floor structure units, the floor structure units comprising:

i. a tray, further comprising:

1. an upper horizontal surface;
2. a lower horizontal surface;
3. at least one retaining wall extending vertically from either of the horizontal surfaces;
4. a first set of interlocking members; and
5. a second set of interlocking members, wherein the first set and the second set are contrapositive, ii. a flooring material disposed on the upper horizontal surface of the tray such that the first set of interlocking members is substantially flush with the flooring material and the second set of interlocking members extends beyond the flooring material;

iii. a rubber matrix disposed in the lower horizontal surface of the tray; and iv. a rubber grommet disposed about the perimeter of the at least one retaining wall of the tray, wherein the rubber grommet and the rubber matrix are connected to form a unitary structure in the floor structure unit.

2. A method according to claim 1, wherein the rubber grommet, the rubber matrix, and the tray are formed by double injection molding.

* * * * *